US006868911B1

(12) United States Patent
Jacobson et al.

(10) Patent No.: US 6,868,911 B1
(45) Date of Patent: Mar. 22, 2005

(54) METHODS AND APPARATUS FOR SUBTERRANEAN FLUID SEPARATION AND REMOVAL

(75) Inventors: Henry P. Jacobson, Stillwater, OK (US); Mark G. Rockley, Stillwater, OK (US)

(73) Assignee: Jacobson Oil Enterprises, Stillwater, OK (US)

( * ) Notice: Subject to any disclaimer, the term of this patent is extended or adjusted under 35 U.S.C. 154(b) by 64 days.

(21) Appl. No.: 10/303,581

(22) Filed: Nov. 25, 2002

(51) Int. Cl.[7] ..... E21B 43/00; E21B 43/38
(52) U.S. Cl. ..... 166/369; 166/67
(58) Field of Search ..... 166/369, 67, 265

(56) References Cited

U.S. PATENT DOCUMENTS

| | | | | | |
|---|---|---|---|---|---|
| 587,124 | A | * | 7/1897 | James | 198/643 |
| 1,007,282 | A | * | 10/1911 | Hawley | 198/529 |
| 1,703,963 | A | | 1/1929 | Scruby | |
| 3,774,685 | A | * | 11/1973 | Rhodes | 166/369 |
| 4,089,784 | A | * | 5/1978 | Ettelt et al. | 210/526 |
| 4,552,220 | A | * | 11/1985 | Jones | 166/369 |
| 4,962,847 | A | * | 10/1990 | Pisors et al. | 198/643 |
| 5,016,708 | A | * | 5/1991 | Baer et al. | 166/68.5 |
| 5,080,781 | A | * | 1/1992 | Evins, IV | 210/112 |
| 5,232,051 | A | * | 8/1993 | Daly | 166/369 |
| 5,348,137 | A | * | 9/1994 | Palmer | 198/643 |
| 5,381,861 | A | * | 1/1995 | Crafton et al. | 166/77.2 |
| 6,041,863 | A | | 3/2000 | Lindsey | |
| 6,659,176 | B2 | * | 12/2003 | Mahadevaiah | 166/250.15 |

* cited by examiner

*Primary Examiner*—Hoang Dang
(74) *Attorney, Agent, or Firm*—Ann Marie Mewherjer; Conley Rose P.C.

(57) ABSTRACT

A method and an apparatus for producing a liquid phase hydrocarbon fluid from a producing formation are provided. One method includes moving an absorbing material through a well disposed in the formation. The absorbing material absorbs the hydrocarbon fluid in the well without absorbing a substantial amount of water in the well. The method includes removing the hydrocarbon fluid from the absorbing material. One apparatus includes an absorbing material configured to absorb the hydrocarbon fluid without absorbing a substantial amount of water. The apparatus also includes a drive assembly configured to move the absorbing material through a well disposed in the formation. In addition, the apparatus includes a collection assembly configured to remove the hydrocarbon fluid from the absorbing material. A method and an apparatus for selectively producing a liquid phase fluid from a formation are also provided. In such embodiments, the absorbing material described above may be hydrophobic or hydrophilic.

20 Claims, 9 Drawing Sheets

METHODS AND APPARATUS FOR SUBTERRANEAN FLUID SEPARATION AND REMOVAL

BACKGROUND OF THE INVENTION

1. Field of the Invention

This invention generally relates to methods and apparatus for subterranean fluid separation and removal. Certain embodiments relate to producing liquid phase hydrocarbon fluids and a negligible amount, if any, of water from a well even if a substantial amount of water is in the well or in the formation surrounding the well.

2. Description of the Related Art

As used herein, the term "hydrocarbon fluid" generally refers to a liquid phase hydrocarbon fluid such as crude oil. Many conventional techniques for hydrocarbon fluid production are known in the art. However, in certain circumstances, conventional recovery techniques are not economically viable since a relatively large fraction of the fluids recovered from the production zone include water or saline water. The water may be attributable to the reservoir such as with coning and channeling and/or to problems with a well such as casing leaks, cement channels, barrier breakdowns, or wells misdirected into high water zones. The produced water is usually separated from the recovered oil at the well head and must be treated prior to disposal or must be re-injected into disposal wells. In many cases, the cost of separating, treating, disposing, and/or re-injecting the produced water may increase the cost of producing oil such that oil production is no longer economically viable. For example, water re-injection disposal costs may be about $0.25 per barrel to about $0.50 per barrel. In addition, if the water must be trucked for disposal, the disposal costs can rise to about $1.50 per barrel.

In the case of oil wells, if a relatively large fraction of the fluids recovered from the production zone includes water or saline water, production of oil from such wells is often marginal. Therefore, such wells may be commonly referred to as "marginal wells." If production from marginal wells is stopped, production from such wells is often not recommenced. Wells that are no longer in production may be commonly referred to as "inactive wells" or "abandoned wells." Abandoned wells present several potential environmental problems because abandoned wells may pollute groundwater and may spill oil and salt water on the surface. Therefore, abandoned wells may also present a potential environmental hazard to humans, animals (i.e., commercial and non-commercial), and vegetation. In addition, abandoned wells may or may not be closed, or "plugged." For example, although oil field companies are required to plug wells after a designated time period of no production is finished, depressed oil prices and the gradual decline of oil fields has forced some operators out of business before the wells are plugged. Abandoned wells that have not been plugged may pose an increased environmental hazard. Therefore, government funding is often used to cover the expense of plugging abandoned wells such that the risk associated with these wells may be reduced.

There are roughly 500,000 or more marginal or abandoned wells in the United States that are estimated to have the capacity to produce about 20% of the oil demand in the United States. Several methods are known in the art for extracting additional oil from previously developed oil fields that have reduced production and that may or may not have been abandoned. Such methods are commonly referred to as "stimulation treatments." Examples of such methods include steam injection, hot oiling, and flushing the wellbore with certain chemicals. Such methods must be repeated periodically to maintain economically satisfactory production. As with other production methods, eventually, the stimulation treatments may cost more than the resulting produced oil thereby rendering the stimulation treatments ineffective or causing the wells to be abandoned.

However, stimulation treatments generally do not address the problems associated with water production from wells. Therefore, such treatments may not be effective for producing oil from a previously developed oil well or a formation having a relatively high water to oil ratio. However, many modem oil fields are being developed more efficiently than previously developed oil fields. For example, some efforts for efficiently developing new oil fields include attempts to reduce the production of water by selecting zones for well completion that do not have the potential of producing a large amount of water. However, such planning and design methodology cannot be applied to existing oil fields, marginal wells, or abandoned wells. Therefore, until oil can be produced from marginal or abandoned wells without producing a substantial amount of water as well, the production of oil from such wells is not economically feasible.

Other efforts have been made to develop technologies for keeping produced water from reaching the surface of the well. For example, polymer gels are used to block water from the wellbore or to improve the sweeping efficiency thereby reducing water production. Determining an appropriate polymer gel for such an application, however, may be very complicated. For example, identifying an appropriate polymer gel depends on correct identification of the water source, correct identification of the conditions in the well such as temperature, salinity, or fluid compatibility, and correct identification of sizing, placement, and application.

In another example, dual-completion water sinks designed to produce oil and water legs separately reduce differential pressure and coning in dual-action pumping systems. Since the dual-completion water sinks separate oil and water downhole and re-inject the water, such sinks reduce the costs of treating the water. There are, however, several disadvantages of dual-completion water sinks. For example, dual-completion water sinks produce oil containing some water and water containing some oil. Therefore, at least some water is produced to the surface and must be disposed. In addition, dual-completion water sinks may not be applicable for formations in which the oil and water legs are not in good pressure communication. Therefore, determining if the oil and water legs are in good pressure communication requires knowledge of the porosity and permeability relationships in the formation. In addition, designing a dual-completion water sink may be complicated because accurate sizing of the perforations and tubing is required such that the reduction of the water leg pressure does not exceed the reduction of the oil leg pressure. Furthermore, for a conventionally-completed marginal or abandoned well, the water sink must first drain any water saturation around the top completion. Such a draining process is a relatively slow process that requires considerable pressure drawdown.

Additional efforts have focused on other technologies for separating water and oil downhole. Downhole oil/water separation provides accelerated oil production in addition to reductions in operating expenses, water handling costs, and lifting costs. Two available technologies for downhole oil/water separation include gravity separation using rod pumps or enhanced gravity separation using hydrocyclones. Such technologies can be used in wells that have a relatively high water to oil ratio, relatively good mechanical integrity, sufficient remaining oil reserves, and a good injection zone (i.e., separation, reasonable pressures, and chemistry compatible with water). However, such technologies generally do not work with heavy oils (i.e., an American Petroleum Institute ("API") gravity less than 10). In addition, the efficiency of the oil/water separation may vary depending on a number of factors such as mixture viscosity, temperature, differential density, inlet water concentration, sand concentration, and gas concentration.

Accordingly, it would be advantageous to develop an extraction method and apparatus in which oil is separated from water downhole in the vicinity of the production zone that does not produce a substantial amount of water from the well, that can produce oil from existing oil wells or new oil wells, that can produce oil from oil wells regardless of the conditions in the oil wells, and that can produce oil from oil wells regardless of the characteristics of the formation in which the wells are completed.

SUMMARY OF THE INVENTION

An embodiment of the invention relates to a method for producing a liquid phase hydrocarbon fluid from a formation that contains hydrocarbons. The formation may be a rock formation. The method includes moving an absorbing material through a well completed in the formation. In one embodiment, moving the absorbing material through the well includes moving the absorbing material through a production zone in the well. The hydrocarbon fluid and water may be in the production zone. As the absorbing material is moved through the well, the absorbing material absorbs the liquid phase hydrocarbon fluid in the well without absorbing a substantial amount of water in the well. For example, the absorbing material may include a porous hydrophobic material surrounding a hollow core. In such embodiments, the hydrocarbon fluid may be absorbed through pores in the absorbing material and into the hollow core. In some embodiments, the absorbing material may include a continuous loop of the absorbing material. In additional embodiments, moving the absorbing material through the well may include moving the absorbing material out of the well through a conduit. In such embodiments, the hydrocarbon fluid may be trapped between an external surface of the absorbing material and an internal surface of the conduit as the absorbing material moves into the conduit.

The method also includes removing the hydrocarbon fluid from the absorbing material. If the absorbing material includes a continuous loop of the absorbing material, moving the absorbing material through the well and removing the hydrocarbon fluid from the absorbing material may be performed continuously. In some embodiments, the hydrocarbon fluid may be removed from the absorbing material as the absorbing material is moved out of the well. In additional embodiments, removing the hydrocarbon fluid from the absorbing material may include applying pressure to the absorbing material. In further embodiments, if the hydrocarbon fluid is trapped between an external surface of the absorbing material and an internal surface of a conduit, the method may include collecting the trapped hydrocarbon fluid as the absorbing material moves out of the conduit. The method may be further configured as described herein.

An additional embodiment relates to an apparatus for producing a liquid phase hydrocarbon fluid from a formation that contains hydrocarbons. The formation may be a rock formation. The apparatus includes an absorbing material configured to absorb the liquid phase hydrocarbon fluid without absorbing a substantial amount of water. The apparatus also includes a drive assembly configured to move the absorbing material through a well completed in the formation. The hydrocarbon fluid and water may be in the well. For example, the hydrocarbon fluid and water may be in a production zone in the well. Therefore, the drive assembly may be configured to move the absorbing material through the production zone. In addition, the apparatus includes a collection assembly configured to remove the hydrocarbon fluid from the absorbing material.

In an embodiment, the absorbing material may be hydrophobic. In some embodiments, the absorbing material may be a hydrophobic polymer. In additional embodiments, the absorbing material may include a continuous loop of the absorbing material. In such embodiments, the drive assembly may be configured to continuously move the absorbing material through the well. In further embodiments, the absorbing material may include a porous material surrounding a hollow core. The porous material may be configured to allow the hydrocarbon fluid to pass through the porous material into the hollow core. In another embodiment, substantially solid plugs may be disposed within a hollow core in the absorbing material. The substantially solid plugs may be spaced from each other within the hollow core. In yet another embodiment, annular plugs may be coupled to an external surface of the absorbing material. The annular plugs may be spaced from each other across the external surface of the absorbing material.

In one embodiment, the apparatus may include a conduit disposed within the well. The conduit may have a substantially smooth internal surface. In such an embodiment, the drive assembly may be configured to move the absorbing material out of the well through the conduit. In some embodiments, an internal diameter of the conduit may be approximately equal to an external diameter of the absorbing material after expansion of the absorbing material caused by absorption of the hydrocarbon fluid. In additional embodiments, the apparatus may include two conduits disposed within the well. The two conduits may have substantially smooth internal surfaces. In such embodiments, the drive assembly may be configured to move the absorbing material into the well through a first of the two conduits and out of the well through a second of the two conduits. In some embodiments, the absorbing material and the second conduit may be configured to trap the hydrocarbon fluid between an external surface of the absorbing material and an internal surface of the second conduit. In further embodiments, the collection assembly may be configured to collect the hydrocarbon fluid trapped between the external surface of the absorbing material and the internal surface of the second conduit. The apparatus may be further configured as described herein.

Another embodiment relates to an apparatus for selectively producing a liquid phase fluid from a formation. The apparatus includes an absorbing material configured to absorb the liquid phase fluid without absorbing a substantial amount of other liquid phase fluids. In some embodiments, the absorbing material may be hydrophobic. In other embodiments, the absorbing material may be hydrophilic. The apparatus also includes a drive assembly configured to move the absorbing material through a well disposed in the formation. The liquid phase fluid and the other liquid phase fluids are disposed in the well. In addition, the apparatus includes a collection assembly configured to remove the liquid phase fluid from the absorbing material. The apparatus may be further configured as described herein.

A further embodiment relates to a method for selectively producing a liquid phase fluid from a formation. The method includes moving an absorbing material through a well disposed in the formation. As the absorbing material is moved through the well, the absorbing material absorbs the liquid phase fluid in the well without absorbing a substantial amount of other liquid phase fluids in the well. In some embodiments, the absorbing material may be hydrophobic. In other embodiments, the absorbing material may be hydrophilic. The method also includes removing the fluid from the absorbing material. The method may be further configured as described herein.

BRIEF DESCRIPTION OF THE DRAWINGS

Other objects and advantages of the invention will become apparent upon reading the following detailed description and upon reference to the accompanying drawings in which.

Figure 1:
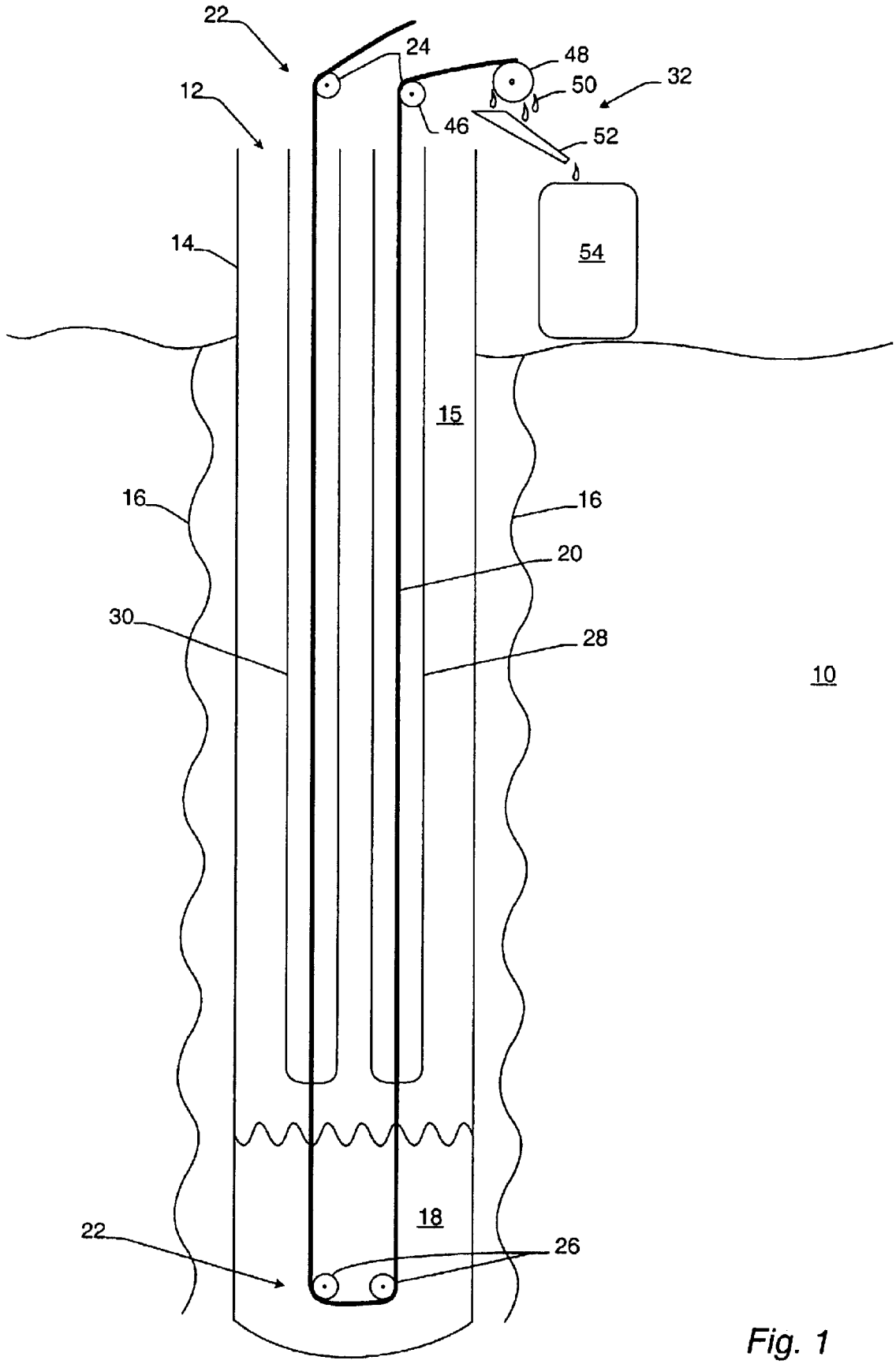
FIG. 1 is a schematic diagram of a partial cross-sectional view of an embodiment of an apparatus for producing a hydrocarbon fluid from a formation.

While the invention is susceptible to various modifications and alternative forms, specific embodiments thereof are shown by way of example in the drawings and will herein be described in detail. It should be understood, however, that the drawings and detailed description thereto arc not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

In further description provided herein, the term "liquid phase hydrocarbon fluid" is used interchangeably with the term "hydrocarbon fluid." In addition, the term "hydrocarbon fluid" is used herein to refer to a hydrocarbon fluid that may include one or more different types of hydrocarbons. Additionally, in further description provided herein, the term "hydrocarbon fluid" is used interchangeably with the term "oil" for the sake of convenience. Furthermore, as used herein, the term "water" is used to refer to water, saline water, and/or any other liquid phase aqueous fluid. A formation refers to a part of the subsurface which may contain several hydrocarbon or water producing zones, but may also contain zones which do not produce water or hydrocarbons.

Turning now to the drawings, FIG. 1 illustrates a schematic diagram of a partial cross-sectional view of an embodiment of an apparatus for producing a liquid phase hydrocarbon fluid from a formation. Formation 10 may include any formation known in the art. Well 12 is disposed in the formation. Well 12 may be disposed in the formation using any method known in the art. Well 12 may include casing 14 surrounding borehole 15. Casing 14 may be formed of a material such as steel and may include any casing known in the art. Packing material 16 may be disposed between casing 14 and formation 10. Packing material 16 may include, but is not limited to, cement, sand, and gravel. Packing material 16, in some cases, is used to reduce the flow of water into well 12 from formation 10 or to stabilize the position of the well in the formation. Well 12 may include other components (not shown) known in the art such as a sucker rod and well head components. The well may be further configured as known in the art.

Hydrocarbon fluid may be disposed in the well. In some cases, water may also be disposed in the well. For example, well 12 may include production zone 18. Although production zone 18 is shown to have a substantially smaller volume than the volume of well 12, it is to be understood that the volume of the production zone may vary substantially from well to well and will not affect the efficiency of the apparatus and methods described herein. Hydrocarbon fluid and some water may be contained within production zone 18. In some cases, formation 10 may contain a substantial fraction of water. In other words, formation 10 may have a relatively high water to oil ratio. In this manner, production zone 18 may also contain a substantial fraction of water and may have a relatively high water to oil ratio. However, each apparatus and method described herein can be used to produce hydrocarbon fluid from the formation regardless of the water fraction in the formation or in the production zone of the well.

In some cases, well 12 may be a marginal well or an abandoned well. As described above, marginal wells and abandoned wells are often not used for production of oil due to relatively low production capability or due to the relatively high production of water from such wells. For example, a marginal well may not be used for production if the economic value of the produced oil does not exceed the costs of production by a certain margin. In addition, a marginal well may not be used for production if the economic value of the produced oil does not exceed the costs of separating, treating, disposing, and/or re-injecting the produced water. Such wells may, therefore, be abandoned even if the wells are capable of producing more oil. Alternatively, well 12 may be a newly developed well or a well in which the production rates have not begun to drop to marginal levels.

The apparatus includes absorbing material 20. The apparats also includes drive assembly 22. Drive assembly 22 is configured to move absorbing material 20 through well 12. As shown in FIG. 1, the absorbing material has a length such that the absorbing material can be extended into the well, through at least a portion of production zone 18, and out of the well. In addition, the drive assembly is configured to move the absorbing material through the production zone. In some embodiments, absorbing material 20 and drive assembly 22 may be configured such that the absorbing material can be moved through a substantial portion of the production zone. For example, the drive assembly and the absorbing material may be configured such that the absorbing material can be moved into the production zone well below the top of the production zone. In this manner, the absorbing material can be moved through a substantial portion, and, in some cases, the entire region of fluids in the borehole that is likely to contain hydrocarbon fluid, whether or not the fluids contain only hydrocarbon fluid of a mixture of hydrocarbon fluid and water.

In some embodiments, the absorbing material may include one or more continuous loops of the absorbing material. In this manner, drive assembly 22 may be configured to continuously move absorbing material 20 through the well and the production zone (i.e., to cycle the absorbing material between the surface and the production zone of the well). For example, the drive assembly may have two axes of rotation to cycle or rotate the absorbing material. The first axis is a driving axis at the surface of the well, and the second axis is a return axis below the top of the production zone in the well.

In some embodiments, drive assembly 22 may include pulley system 24 located near a well head of the well. Pulley system 24 forms the driving axis of the drive assembly at the surface of the well. Although pulley system 24 is shown in FIG. 1 to include only two pulleys, pulley system 24 may be further configured as illustrated in other figures described herein. Drive assembly 22 may also include one or more electric motors (not shown) coupled to pulley system 24. The electric motors may be configured to actuate pulley system 24. In addition, the drive assembly may include any other devices known in the art, which may be configured to actuate the pulley system such as a fuel-driven motor. The electric motors may include any electric motors known in the art. In some embodiments, a 2 hp electric motor may be appropriate. In additional embodiments, the electric motor may be a variable speed electric motor. The type of electric motor may vary, however, depending upon various characteristics of the apparatus such as the configuration of the pulley system, the weight of the absorbing material, and the rate at which the absorbing material is to be moved. For example, in further embodiments, a 0.5 hp electric motor, or even a 1/12 hp or a 1/40 hp motor, may be sufficient to actuate pulley system 24 to thereby impart motion to the absorbing material. Selecting an electric motor based on such characteristics is known in the art, and therefore will not be described further herein.

Due to the relatively low power requirements of the electric motors described above, the power requirements of the electric motors may be supplied by solar power. Therefore, the power requirements of the apparatus may be met at a relatively low cost thereby reducing the overall cost of production. In addition, pulley system 24 and the electric motor or fuel-driven motor constitute the primary components of the well head mechanics. In this manner, the apparatus is substantially cost efficient and substantially more cost efficient than other conventional apparatus for the production of hydrocarbon fluid.

Drive assembly 22 may also include a return device located proximate the bottom of the well or located at least within the production zone in the well. In one embodiment, the return device includes pulley system 26 disposed within a production zone in well 12. Pulley system 26 forms the return axis of the drive assembly below the top of the production zone in the well. Although pulley system 26 is shown to include 2 pulleys in FIG. 1, it is to be understood that pulley system 26 may include any number of pulleys. For example, pulley system 26 may include 1, 2, 3, 4, 5, 6, 7, 8, or more pulleys. However, if possible, the number of pulleys included in pulley system 26 should be minimized to reduce the number of moving components downhole. In this manner, the potential for mechanical failure downhole may be reduced.

Pulley systems 24 and 26 may be configured to guide absorbing material 20 into the well, through the production zone, and back out of the well. In some embodiments, the apparatus may include conduit 28 disposed within well 12. In such embodiments, pulley system 24 may be configured to guide absorbing material 20 into conduit 28. In additional embodiments, the apparatus may include conduit 30 disposed within well 12. In such embodiments, pulley system 26 may be configured to guide absorbing material 20 from the production zone and into conduit 30. In addition, pulley system 24 may be configured to guide the absorbing material from conduit 30 to collection assembly 32.

Conduits 28 and 30 may include sections of pipe coupled together. In some embodiments, the pipe may be formed of a material such as poly(vinyl chloride) (PVC) or another appropriate material known in the art. For example, the pipe may be formed of polypropylene. Conduits 28 and 30 may be formed of the same material or different materials. In some embodiments, the sections of pipe may be coupled by an adhesive. In other embodiments, the sections of pipe may be welded together, fitted together by an interlocking mechanism formed on opposite ends of the sections, or coupled by a clamping mechanism. Conduits 28 and 30 may be coupled to a sucker rod disposed in the borehole. For example, conduits 28 and 30 may be coupled to the sucker rod by clamping devices such as strap clamps spaced apart across the conduits by about 3 ft to about 6 ft. The sucker rod may provide for mechanical strength and support for the conduits.

As shown in FIG. 1, conduits 28 and 30 may extend from a well head of well 12 into the borehole and to a position above an upper surface of production zone 18. However, in some embodiments, conduits 28 and 30 may extend below an upper surface of the production zone. Conduits 28 and 30 may have the same length or different lengths. In addition, conduits 28 and 30 may extend to different depths within the borehole. For example, a lowermost portion of conduit 28 may be above an upper surface of production zone 18, and a lowermost portion of conduit 30 may be below an upper surface of the production zone.

Conduits 28 and 30 have an internal diameter that is substantially smaller than an internal diameter of casing 14. In some embodiments, casing 14 may have an internal diameter of about 4.5 inches or about 7 inches. The conduits also have an internal diameter that is greater than an outside diameter of absorbing material 20. For example, conduits 28 and 30 may have an internal diameter of about 0.3 inches to about 0.8 inches, and, in some embodiments, an internal diameter of about 0.5 inches or about 0.62 inches. In addition, conduits 28 and 30 may have the same internal diameter or different internal diameters. For example, as described in more detail herein, after absorbing material 20 moves through production zone 18, the absorbing material may expand due to the absorption of hydrocarbon fluid. Therefore, in some embodiments, conduit 30 may have a greater internal diameter than conduit 28. In addition, in some embodiments, conduit 30 may have an internal diameter that is approximately equal to an external diameter of absorbing material 20 after expansion of the absorbing material caused by absorption of the hydrocarbon fluid.

In other embodiments, conduit 30 may have an internal diameter that is greater than an external diameter of absorbing material 20 after expansion of the absorbing material due to absorbed hydrocarbon fluid. In this manner, contact between the absorbing material and an internal surface of conduit 30 may be reduced. As such, the amount of hydrocarbon fluid that may be removed from the absorbing material by conduit 30 upon entrance of the absorbing material into the conduit or during movement of the absorbing material through the conduit may be reduced. In some embodiments, a lowermost portion of conduit 30 proximate the production zone may have a larger internal diameter than other portions of the conduit. For example, the lowermost portion of the conduit may be flared outward thereby further reducing contact between the absorbing material and the internal surface of the conduit as the absorbing material enters the conduit.

Conduits 28 and 30 may be included in the apparatus to reduce wear on the absorbing material that may be caused by moving the absorbing material through the casing. The internal surfaces of the conduits may be substantially smoother than an internal surface of the well casing. In some embodiments, conduits 28 and 30 may have substantially smooth internal surfaces (i.e., an internal surface having relatively low roughness). In this manner, conduits 28 and 30 may reduce wear on the absorbing material as the material moves through conduits 28 and 30 by reducing friction between the absorbing material and the internal surface of the conduit. In addition, conduit 30 eliminates contact between the well casing and/or other components disposed within the well casing after the absorbing material has absorbed hydrocarbon fluid in the production zone. In this manner, the conduit may eliminate the amount of hydrocarbon fluid that may be removed from the absorbing material during transport of the absorbing material and the absorbed hydrocarbon fluid out of the well. In alternative embodiments, however, the apparatus may not include conduit 28. In such embodiments, the absorbing material may be moved into the well and into the production zone through the casing.

Absorbing material 20 is configured to absorb liquid phase hydrocarbon fluid without absorbing a substantial amount of water. For example, the absorbing material may be hydrophobic. Therefore, as the absorbing material is moved through a production zone in a well, the absorbing material will absorb hydrocarbon fluid. The absorbing material, however, will not absorb a substantial amount of water even if the production zone contains a relatively large fraction of water. In this manner, the absorbing material selectively absorbs the hydrocarbon fluid thereby separating the absorbed hydrocarbon fluid from water in the production zone. Therefore, the absorbing material performs the separation as the absorbing material is moved through the production zone downhole. Furthermore, since the absorbing material does not absorb a substantial amount of water, the hydrocarbon fluid that is produced from the well does not contain a substantial amount of water. In some cases, the produced hydrocarbon fluid may be-substantially free of water.

An apparatus or method that uses such an absorbing material to produce hydrocarbon fluid provides several advantages over conventional apparatus and methods for producing hydrocarbon fluid. For example, hydrocarbon fluid production from wells, in which there may be a substantial fraction of water in the formation, is achieved without the production of the water from the production zone in the well. In addition, the absorbing material both wicks and carries the bulk hydrocarbon fluid to the surface without also carrying water in the production zone or in the borehole of the well to the surface. Therefore, such an apparatus and method may produce hydrocarbon fluid much more economically than conventional production technologies since such a downhole separation substantially reduces, and may even eliminate, costs associated with separating, treating, disposing, and/or re-injecting water. Furthermore, such an apparatus and method may produce oil much more economically from wells and production zones that contain a substantial fraction of water than conventional production techniques. Moreover, since the hydrocarbon fluid is produced from the well by removing the absorbing material from the well, the apparatus and methods described herein do not require the use of pumps to transport the hydrocarbon fluid from the production zone to the top surface (i.e., the absorbing material itself acts as a pump). As such, the production costs may be reduced by eliminating the pumps and the costs of operating and maintaining the pumps. In addition, the production rate depends on the linear velocity of the absorbing material. Therefore, the production rate may be altered easily by altering the linear velocity of the absorbing material. In addition, the linear velocity of the absorbing material may be altered depending on the rate at which the production zone is replenished with hydrocarbon fluid. In one example, at a linear velocity of the absorbing material of 0.5 ft/sec, the production rate of this apparatus was measured to be about 2 barrels of oil/day to about 4 barrels of oil/day.

In one embodiment, the absorbing material may include a hydrophobic polymer. In some embodiments, the absorbing material may include any natural or synthetic hydrophobic polymer. One example of an appropriate hydrophobic polymer is polypropylene. In such an embodiment, the absorbing material may include a twisted weave rope. In some embodiments, the twisted weave rope may be reinforced with another material such as graphite fibers. The twisted weave rope may have a hollow core. In one example, the absorbing material may include size #16 hollow braid polypropylene rope having an external diameter of about 0.5 inches. In some embodiments, the absorbing material may be circular or elliptical in cross-section under un-strained conditions. In other embodiments, the absorbing material may be flat or linear in cross-section such as a "flat rope" might be under un-strained conditions.

As described above, the absorbing material may include a continuous loop of the absorbing material. In addition, the absorbing material may include more than one continuous loop of the absorbing material. In such embodiments, the ends of length of absorbing material may be coupled to form a continuous loop after being threaded through conduit 30 and conduit 28 and after being coupled to drive assembly 22. In some embodiments, the ends of the length of polymer absorbing material may be coupled by weaving a portion of the length of absorbing material adjacent to both ends together. In other embodiments, the ends of the length of polymer absorbing material (which in some cases may be a polymeric braided rope) may be knotted and fused, for example, by cauterizing using an appropriate soldering iron or another heat source that may melt the polymer rope. One example of an appropriate soldering iron may include a 15 W soldering iron having a wood burning tip. The ends of the polymer rope may also be doubled back over the center and coupled or fused, for example, using the cauterizing method described above. In another embodiment, the ends of the polymer rope may be doubled back over the center and coupled or fused to a different twisted weave rope inserted into the polymer rope proximate the ends of the polymer rope. The ends of the polymer rope may be coupled or fused to the different twisted weave rope as described herein. In one example, the different twisted weave rope may have a length of about 3 cm to about 20 cm, or about 10 cm. The different twisted weave rope may include, for example, a size #2 hollow braid polypropylene rope having an external diameter of about 5/16 inches. The ends of the polymer rope may be coupled, however, using any method or apparatus known in the art.

In other embodiments, the absorbing material may include a porus material surrounding a hollow core. In addition, the weaving of the rope may be considered to be a porus material since the rope contains openings between an external surface of the rope and the internal surface of the rope. In either embodiment, the weaving of the rope or the porus material may be configured to allow hydrocarbon fluid to pass through the weaving or the porus material and into the hollow core of the absorbing material as the absorbing material moves through the fluids in the well. In addition, the weaving of the rope or the porus material may include openings or pores of sufficient diameter to allow hydrocarbon fluid to pass from the production zone into the hollow core with a hydrostatic head not greater than about 1 inch of oil.

Depending on the composition of the absorbing material and the composition of the fluids in the production zone, it is estimated that the absorbing material may be used in the apparatus and methods described herein for about 3 months to about 6 months before being replaced. Therefore, replacement of the absorbing material will not cause substantial down time or production losses. In addition, replacing the absorbing material may be a relatively simple process. Therefore, maintaining and/or replacing the absorbing material may be a relatively simple, quick, and inexpensive process.

Figure 2:
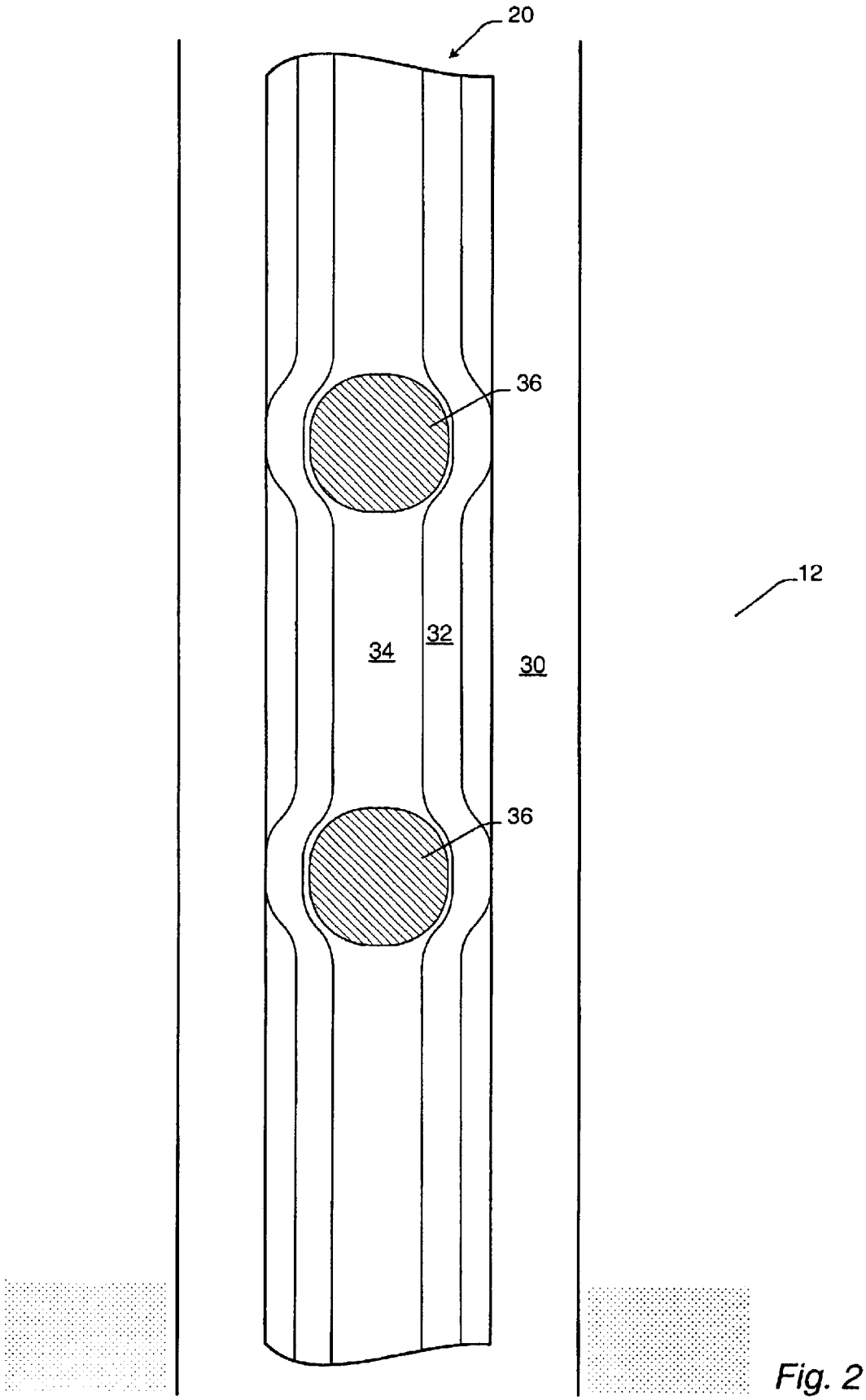
FIGS. 2–3 are schematic diagrams of a partial cross-sectional view of various embodiments of an absorbing material and substantially solid plugs coupled to the absorbing material, which may be included in an apparatus for producing a liquid phase hydrocarbon fluid from a formation.

FIG. 2 is a schematic diagram of a partial cross-sectional view of an embodiment of absorbing material 20 disposed within conduit 30. As shown in FIG. 2, absorbing material 20 includes material 32 surrounding hollow core 34. Material 32 may be a twisted weave rope or a porous material as described above. Substantially solid plugs 36 are disposed within hollow core 34. Plugs 36 may be formed of a hydrophobic material. In some embodiments, plugs 36 may be formed of a hydrophobic polymer such as nylon, polypropylene, polyester, polytetrafluoroethylene, high density polyethylene, ultra high molecular weight polyethylene, neoprene, viton, and polyethersulfone. In one embodiment, the plugs may be formed of substantially solid nylon rope. In other embodiments, plugs 36 may include an inner twisted weave rope, which may be cauterized at both ends. The inner twisted weave rope may include, for example, a size #2 hollow braid polypropylene rope having an external diameter of about 5/16 inches or a hollow braid polypropylene rope having an external diameter of about 3/8 inches. Each of the plugs may or may not be formed of the same material.

Plugs 36 have a length that is substantially smaller than a length of material 32. For example, the plugs may have a length that is about 0.5 inches to about 4 inches. In some embodiments, the plugs may have a length of about 1 inch. Each of the plugs may or may not have the same length. Plugs 36 are arranged within hollow core 34 such that the substantially solid plugs are spaced from each other within the hollow core. The plugs may be spaced from each other by about 0.3 m to about 2 m. In some embodiments, the plugs may be spaced from each other by about 1 m. The spacing between the plugs may vary depending upon the absorption characteristics of the absorbing material. For example, as described above, some of the hydrocarbon fluid in the production zone will pass through pores or weaving in the absorbing material and into the hollow core. The substantially solid plugs are configured to effectively seal the hollow core. Therefore, the plugs allow a plug of hydrocarbon fluid to be retained above the plugs as the absorbing material is moved out of the production zone and out of the well. In addition, the substantially solid plugs may be configured to reduce the hydrostatic head of the absorbed hydrocarbon fluid within the absorbing material such that the absorbed hydrocarbon fluid will not be forced back out of the absorbing material. For example, the hydrostatic head of the absorbed hydrocarbon fluid depends on the height of the absorbed hydrocarbon fluid between plugs. Therefore, the hydrostatic head of the absorbed hydrocarbon fluid can be modified by altering a spacing between plugs 36.

Figure 3:
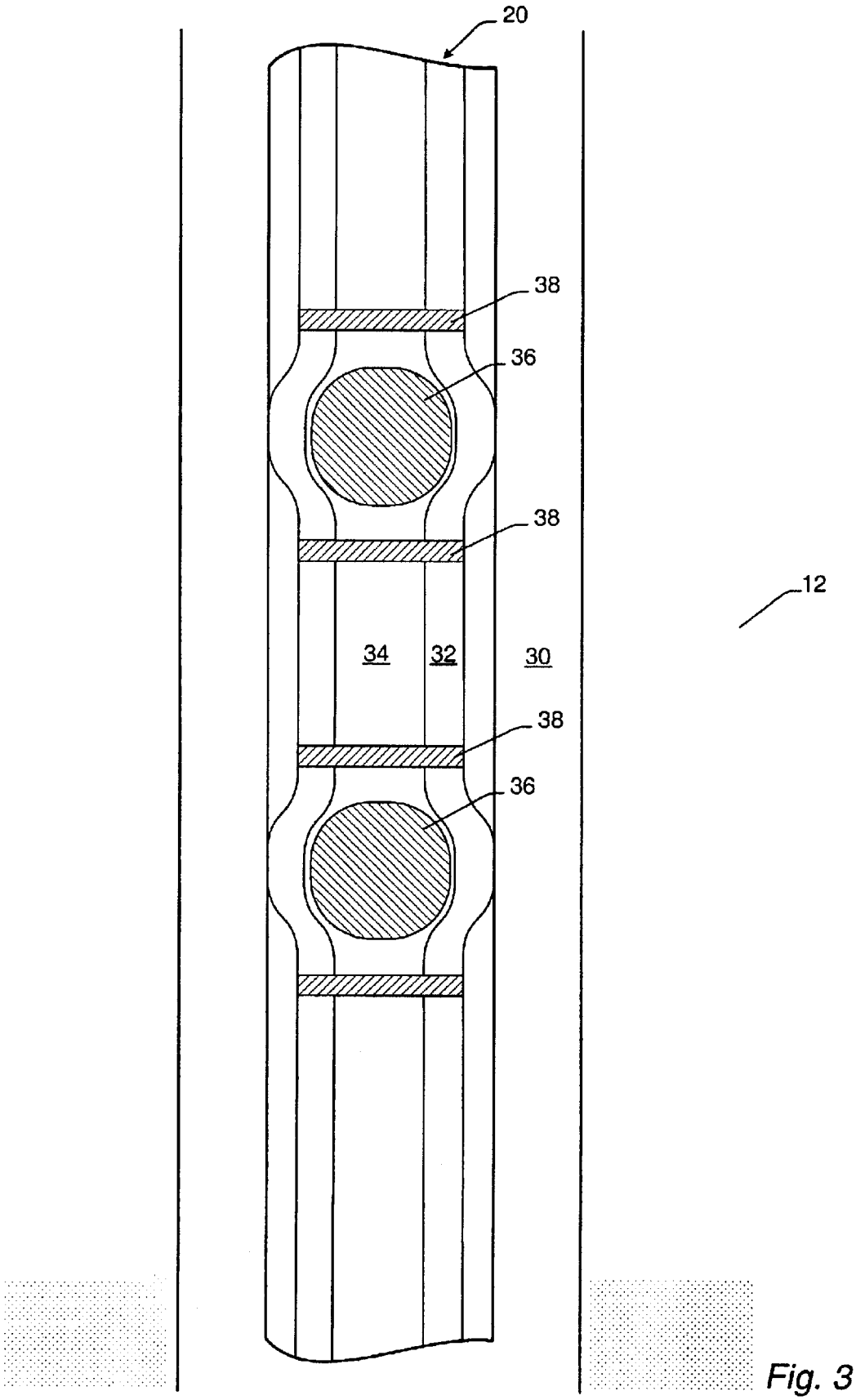

Substantially solid plugs 36 may be coupled to the absorbing material such that the positions of the plugs do not alter during production. In some embodiments, the plugs may be coupled to an internal surface of the absorbing material. For example, the plugs may be sewn into the hollow core of the absorbing material. In one example, the plugs may be sewn into the absorbing material using 50 lb. monofilament test line and an interlocking loop method. Alternatively, the plugs may be coupled to the absorbing material by a hydrophobic material external to the absorbing material that restricts movement of the plugs within the hollow core. In one embodiment, as shown in FIG. 3, the positions of plugs 36 within the hollow core may be restricted by sewing 38, which is configured to reduce the internal diameter of the absorbing material above and below the plugs. Sewing 38 may be formed of a hydrophobic material such as the hydrophobic materials described above. In addition, sewing 38 may be formed of the same material as absorbing material 20 and/or plugs 36. Alternatively, sewing 38 may be formed of a different material than absorbing material 20 and/or plugs 36.

In some embodiments, as shown in FIG. 2, plugs 36 may have a width that is greater than a width of the hollow core when the absorbing material is under tension. In this manner, plugs 36 may be configured to keep the center of the absorbing material open or to maintain a selected width of the hollow core during production. Since plugs 36 have a greater width than the hollow core when the absorbing material is under tension, the absorbing material does not have a uniform external diameter over the length of the absorbing material.

In addition, the width of the substantially solid plugs may be selected such that an external diameter of the absorbing material proximate the substantially solid plugs is approximately equal to an internal diameter of conduit 30. For example, the external diameter of the absorbing material proximate the substantially solid plugs may be approximately 3% less than an internal diameter of the conduit. In this manner, plugs 36 may be configured to reduce the difference between the internal diameter of conduit 30 and the external diameter of the absorbing material at periodic intervals. Therefore, the plugs may form relatively loose fluid seals between the absorbing material and conduit 30. As such, hydrocarbon fluid on the outside of the absorbing material may be trapped between an external surface of the absorbing material and the internal surface of the conduit. In addition, the plugs are configured to space an external surface of the absorbing material extending between the plugs from an internal surface of conduit 30. Therefore, the plugs may reduce, and may even prevent, draining of hydrocarbon fluid from the absorbing material that may be caused by contact between an external surface of the absorbing material and an internal surface of the conduit. In this manner, hydrocarbon fluid on the outside of the absorbing material may be transferred to the surface of the well. Therefore, the presence of plugs 36 within the hollow core of absorbing material 20 may allow increased production rates of hydrocarbon fluid in comparison to the absorbing material alone.

Figure 4:
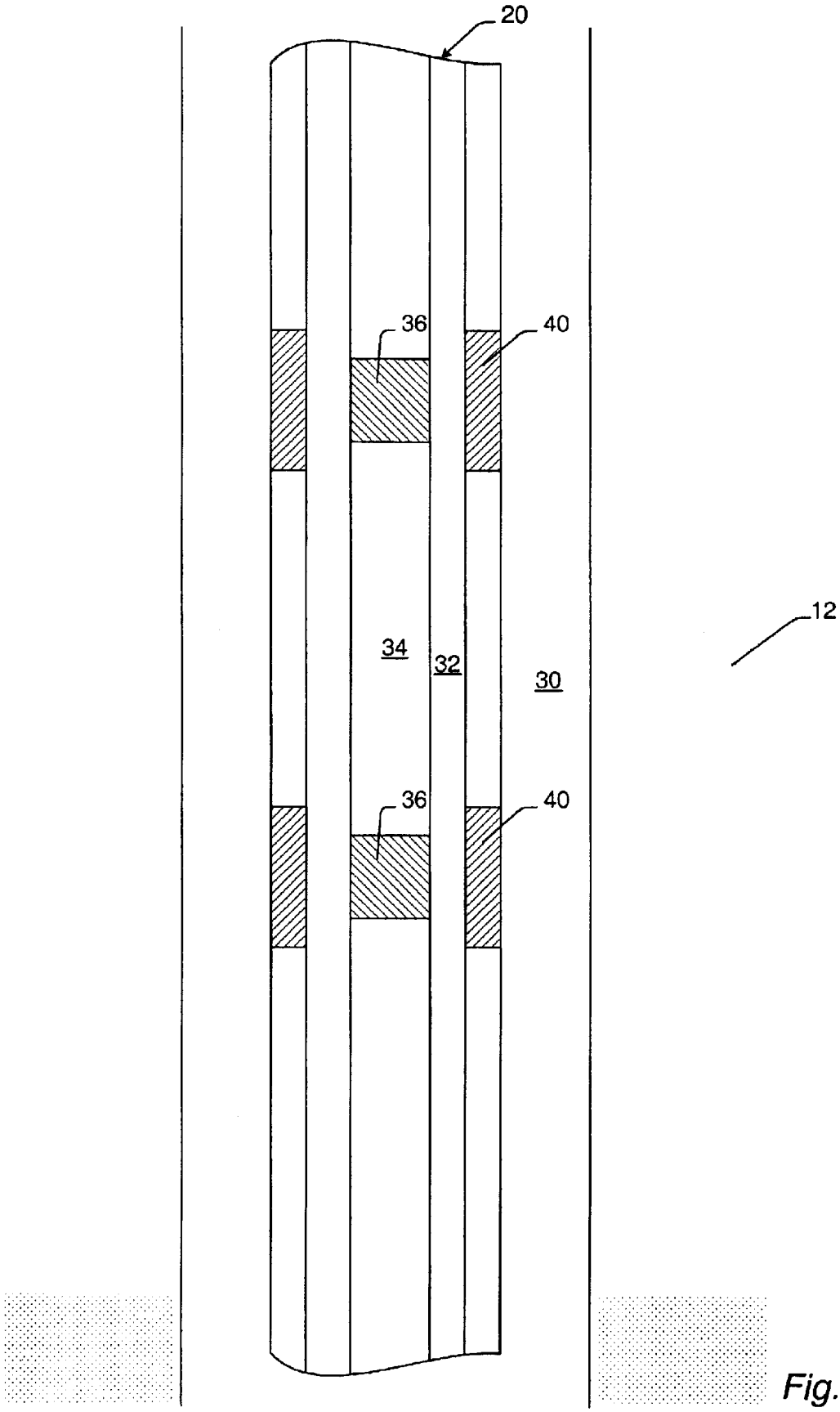
FIGS. 4–5 are schematic diagrams of a partial cross-sectional view of various embodiments of an absorbing material, substantially solid plugs coupled to the absorbing material, and annular plugs coupled to the absorbing material, which may be included in an apparatus for producing a liquid phase hydrocarbon fluid from a formation.

In another embodiment, as shown in FIG. 4, plugs 36 may have a width that is approximately equal to a width of the hollow core when the absorbing material is under tension. Since plugs 36 have a width that is approximately equal to the width of the hollow core, the absorbing material may have a substantially uniform external diameter over the length of the absorbing material. The embodiment of plugs 36 illustrated in FIG. 4 may be further configured as described above.

As further shown in FIG. 4, annular plugs 40 may be coupled to an external surface of absorbing material 20. Annular plugs 40 may be formed of a hydrophobic material. In one embodiment, the annular plugs may be formed of a rubber material such as neoprene. The annular plugs may be formed using a mold or by extruding the hydrophobic material over the absorbing material. The rubber material may have a sufficiently low melting temperature such that the absorbing material is not destroyed during the extrusion process. In some embodiments, the rubber material may be pressurized, or the composition of the rubber material may be selected such that the rubber material is relatively resistant to hydrocarbon fluid thereby reducing degradation of the annular plugs during production. In other embodiments, annular plugs 40 may be formed of a hydrophobic polymer such as nylon, polypropylene, polyester, polytetrafluoroethylene, high density polyethylene, ultra high molecular weight polyethylene, and polyethersulfone. In one embodiment, the annular plugs may be formed of substantially solid nylon rope. In another embodiment, the annular plugs may be formed of polyester having a thickness of about 1 mm. Each of the annular plugs may or may not be formed of the same material. In addition, the annular plugs and substantially solid plugs 36 may be formed of the same material or different materials. Furthermore, the annular plugs and the absorbing material may be formed of the same material or different materials.

As shown in FIG. 4, annular plugs 40 may be spaced from each other across the external surface of absorbing material 20. For example, the annular plugs may be spaced from each other by about 0.25 m to about 10 m. In some embodiments, the annular plugs may be spaced from each other by about 1 m. In some embodiments, the spacing between each of the external plugs may be substantially the same or may be different. In additional embodiments, the spacing between each of the annular plugs may be substantially the same as or different than the spacing between each of the substantially solid plugs. In this manner, positions of annular plugs 40 along the external surface of absorbing material 20 may coincide with positions of substantially solid plugs 36 within the hollow core of the absorbing material. Alternatively, positions of annular plugs 40 along the external surface of absorbing material 20 may not coincide with positions of substantially solid plugs 36 within the hollow core of the absorbing material.

Annular plugs 40 have a length that is substantially less than a length of absorbing material 20. For example, the annular plugs may have a length that is about 0.5 inches to about 10 inches. In some embodiments, the plugs may have a length of about 1 inches. Each of the annular plugs may or may not have the same length. In some embodiments, annular plugs 40 may have a length that is greater than the length of substantially solid plugs 36. In other embodiments, annular plugs 40 may have a length that is less than or approximately equal to a length of substantially solid plugs 36. A width of the annular plugs may vary depending on the internal diameter of conduit 30 and the external diameter of absorbing material 20. For example, the annular plugs may be configured to reduce the difference between the internal diameter of conduit 30 and the effective external diameter of the absorbing material at periodic internals. In one example, the annular plugs may reduce the difference between the internal diameter of conduit 30 and the effective external diameter of absorbing material 20 to less than about 3%. In this manner, the annular plugs form relatively loose fluid seals between the absorbing material and conduit 30. As such, hydrocarbon fluid on the outside of the absorbing material may be trapped between an external surface of the absorbing material and the internal surface of the conduit. In addition, the annular plugs are configured to space an external surface of the absorbing material extending between the annular plugs from an internal surface of conduit 30. Therefore, the annular plugs may reduce, and may even prevent, draining of hydrocarbon fluid from the absorbing material that may be caused by contact between an external surface of the absorbing material and an internal surface of the conduit. In this manner, hydrocarbon fluid on the outside of the absorbing material may be transferred to the surface of the well. Therefore, the presence of annular plugs 40 coupled to an external surface of absorbing material 20 may allow increased production rates of hydrocarbon fluid in comparison to the absorbing material alone. For example, in some embodiments, the presence of annular plugs 40 coupled to the external surface of the absorbing material may increase the production rate of hydrocarbon fluid by about 5 times to about 10 times or more.

Figure 5:
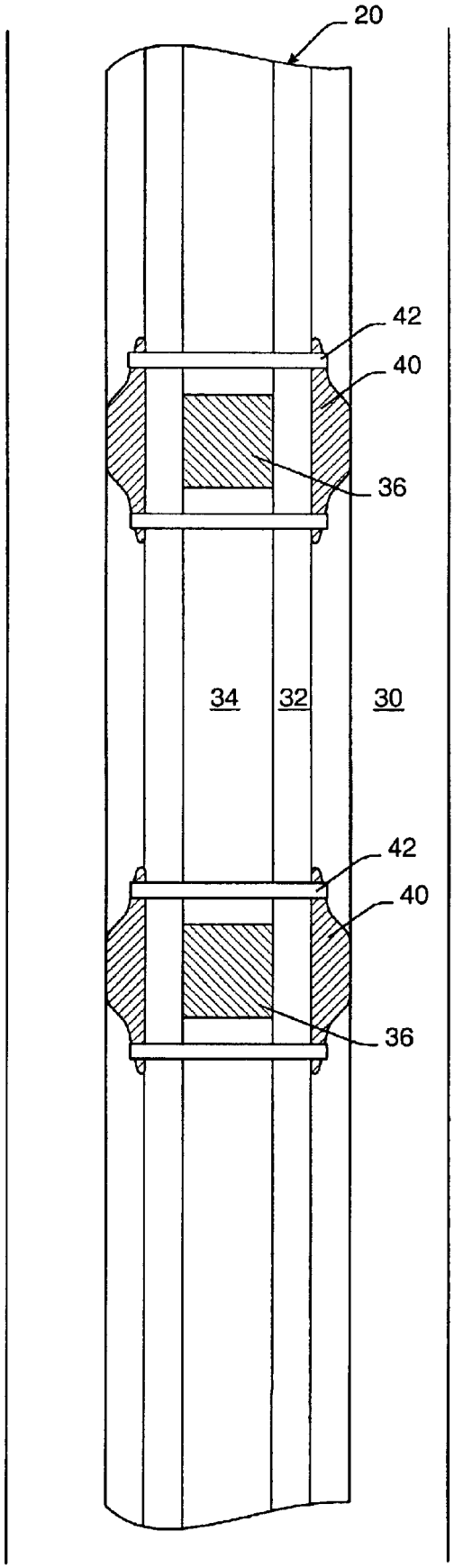

As shown in FIG. 4, the annular plugs may have a substantially constant width over the length of the plugs. In this manner, the annular plugs may be configured as cylindrical sheaths. However, as shown in FIG. 5, a width of annular plugs 40 may vary across the length of the plugs. For example, the width of the annular plugs may increase from the outer lateral edges of the annular plugs to a central portion of the annular plugs. Such reduced width at the outer lateral edges of the annular plugs may ease the movement of the absorbing material into the conduit. As further shown in FIG. 5, annular plugs 40 may be coupled to an external surface of absorbing material by sewing 42. Sewing 42 may be configured to restrict the positions of annular plugs 40. Sewing 42 may be formed of a hydrophobic material such as any of the hydrophobic materials described above. In addition, sewing 42 may be formed of the same material as absorbing material 20, plugs 36, and/or annular plugs 40. Alternatively, sewing 42 may be formed of a different material than absorbing material 20, plugs 36, and/or annular plugs 40.

Referring back to FIG. 1, pulley system 24, which is a portion of drive assembly 22, may also be a portion of the collection assembly of the apparatus. The collection assembly is configured to remove hydrocarbon fluid from the absorbing material. For example, the collection assembly may be configured to remove hydrocarbon fluid absorbed into the absorbing material by mechanical action. The mechanical action may be accomplished by applying pressure to the absorbing material or by compressing the absorbing material. The mechanical action also serves as at least a portion of the driving mechanism for cycling the absorbing material through the well. For example, in some embodiments, the collection assembly may include one or more of the pulleys included in pulley system 24. For example, as shown in FIG. 1, collection assembly 32 includes pulley 46. Pulley 46 may be considered to be part of drive assembly 22. Collection assembly 32 also includes pulley 48. Pulley 48 may be configured to apply pressure to absorbing material 20. For example, in one embodiment, pulley 48 may be a v-grooved pulley. In this manner, as the absorbing material contacts the pulley, the absorbing material may be squeezed into the v-groove. As such, hydrocarbon fluid absorbed within the absorbing material may be forced out of the absorbing material.

In some embodiments, hydrocarbon fluid 50 forced out of the absorbing material is allowed to flow freely from the absorbing material and the pulley. In such an embodiment, collection assembly 32 may include collection tray 52. The collection tray may be formed of any appropriate material known in the art such as, but not limited to, stainless steel or PVC. In addition, the collection tray may be formed of a flexible material, a semi-rigid material, or a rigid material. Collection tray 52 may have a width that is greater than the width of pulley 48. Collection tray 52 also has a recessed portion that is surrounded on at least two sides by raised portions. The raised portions may be arranged on opposite sides of the pulley. The raised portions may have a height that is sufficient to prevent a substantial amount of hydrocarbon fluid from flowing over the sides of the tray. In this manner, the collection tray may be configured as an open channel, or in some cases the lower portion of a conventional channel. In some embodiments, however, the collection tray may also be partially covered. In this manner, a portion of the collection tray may be an open channel, and the other portion of the collection tray may be a closed channel. Such a partially covered tray may be appropriate if, for instance, vessel 54 is located a substantial distance from pulley 48 or if the hydrocarbon fluid may be altered by environmental conditions during flow through the collection tray.

In addition, collection tray 52 is arranged at an angle such that hydrocarbon fluid 50 can flow under gravitational forces into vessel 54. Vessel 54 may include any appropriate containment device such as a tank or a barrel. Vessel 54 may have an inlet (not shown) that may be coupled to the downstream end of the collection tray. Alternatively, vessel 54 may have an inlet that is configured such that the downstream end of the collection tray can be positioned above the inlet and such that the hydrocarbon fluid can flow freely from the collection tray into the vessel. For example, the inlet may be an opening disposed within a top surface of the vessel. The opening may have lateral dimensions greater than the lateral dimensions of the downstream end of the collection tray. In this manner, a substantial portion of the hydrocarbon fluid may flow from the collection tray into the vessel. In some embodiments, the vessel may also have an outlet. The outlet may be coupled to conventional flow devices such as conduits and pumps. In this manner, the produced hydrocarbon fluid may be transferred from the outlet of the vessel to a top surface processing facility, a distribution system, and/or a transportation system.

The collection assembly may also be configured to collect hydrocarbon fluid that is trapped between the external surface of the absorbing material and the internal surface of conduit 30. For example, hydrocarbon fluid may be trapped between the absorbing material and the conduit as the absorbing material enters the conduit. As described above, substantially solid plugs 36 or annular plugs 40 may form loose fluid seals between the absorbing material and the conduit. In this manner, hydrocarbon fluid trapped between the absorbing material and the conduit may be transferred to the surface of the well as the absorbing material moves through the conduit. Therefore, as the absorbing material moves out of the conduit, substantially solid plugs 36 or annular plugs 40 will push the trapped hydrocarbon fluid out of the conduit. The trapped hydrocarbon fluid may flow freely out of the conduit at the surface of the well.

In some embodiments, the collection tray described above may be configured to extend to the conduit and may be coupled to the conduit below an uppermost surface of the conduit such that the collection tray surrounds the conduit. In this manner, the collection tray may be configured to collect the hydrocarbon fluid that flows freely from the conduit in addition to the hydrocarbon fluid that is removed from the absorbing material by compression of the absorbing material. The hydrocarbon fluid that flows out of the conduit and the hydrocarbon fluid recovered from the absorbing material may be transferred into the same vessel.

Alternatively, the collection assembly may include another collection device (not shown) configured to collect the hydrocarbon fluid that flows out of the conduit. This additional collection device may or may not also collect hydrocarbon fluid removed from within the absorbing material. The additional collection device may include, but is not limited to, an additional collection tray, a drain surrounding the conduit and coupled to a pipe or another conduit, a piping arrangement, or any other appropriate device known in the art. The additional collection device may transfer the hydrocarbon fluid that flows out of the conduit to the same vessel to which the hydrocarbon fluid removed from the absorbing material is transferred. In one embodiment, the additional collection device may transfer the hydrocarbon fluid flowing out of the conduit to the collection tray, which may then be transferred from the collection tray to the vessel. Alternatively, the additional collection device may transfer the hydrocarbon fluid flowing out of the conduit to a different vessel. The collection assembly illustrated in FIG. 1 may be further configured as described herein.

Figure 6:
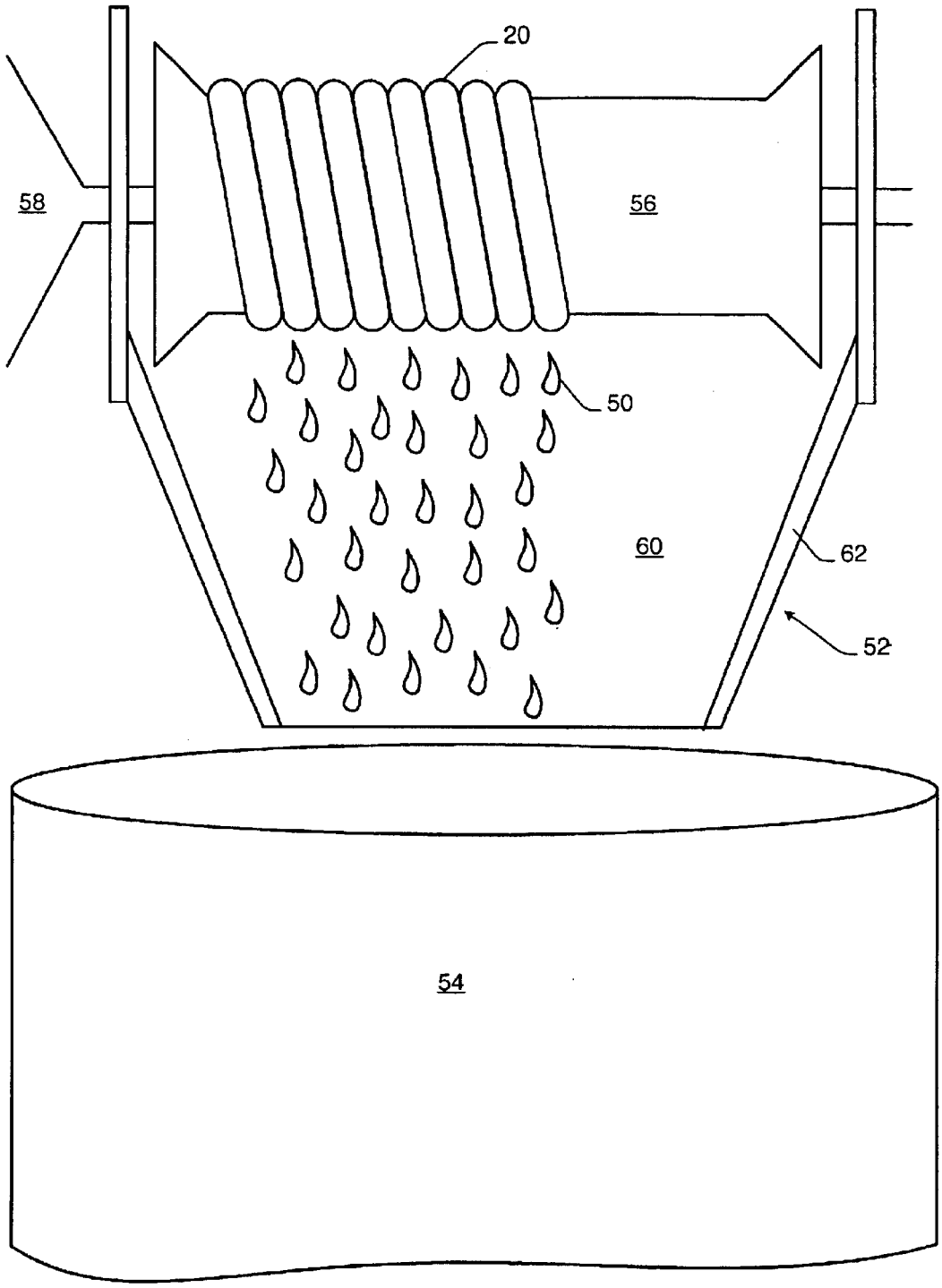
FIGS. 6–9 are schematic diagrams of a partial side view of various embodiments of a collection assembly, which may be included in an apparatus for producing a liquid phase hydrocarbon fluid from a formation.
Figure 9:
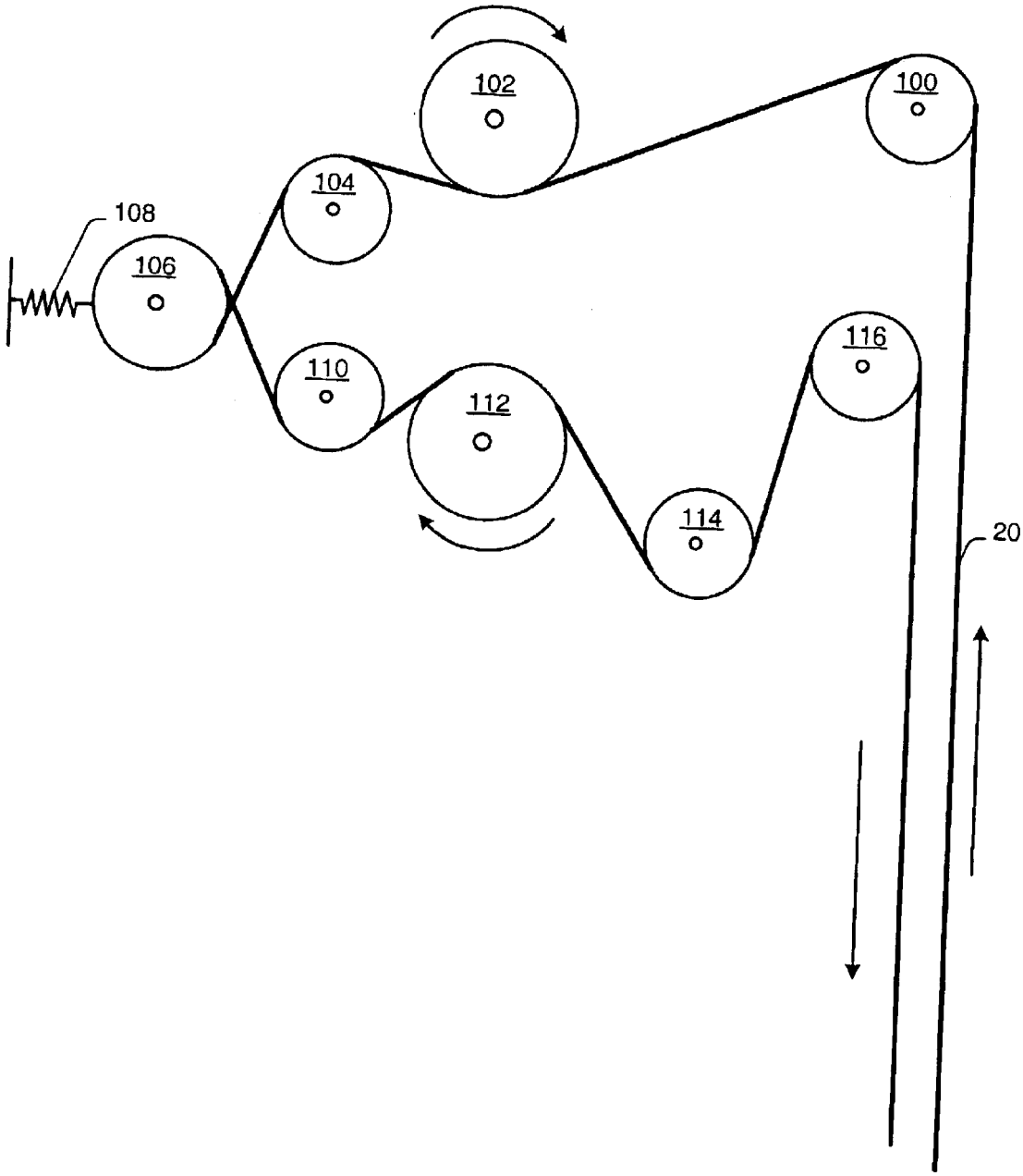

For example, FIG. 6 illustrates a portion of another embodiment of a collection assembly. In this embodiment, the collection assembly includes capstan 56. Capstan 56 may be used in place of pulley 48 or may be used in addition to pulley 48. Capstan 56 is coupled to motor gear rod 58, which may be configured to actuate capstan 56. In some embodiments, a diameter of the capstan may be approximately 2 inches to approximately 10 inches. In particular, a diameter of the capstan may be approximately 3 inches. In such an embodiment, absorbing material 20 may be wrapped around the capstan about 4 or more times. In this manner, the capstan may have an effective contact area of about 38 inches. As the absorbing material wraps around the capstan, the absorbing material may be pressed against the surface of the capstan. The absorbing material may also be pressed against other portions of the absorbing material that have previously been wrapped around the capstan. In this manner, the capstan essentially "wrings" the hydrocarbon fluid out of the absorbing material. In other embodiments, capstan 56 may be replaced with one or more v-grooved pulleys on a single shaft. For example, capstan 56 may be replaced with two v-grooved pulleys on a single shaft. The two v-grooved pulleys may have a diameter of about 9 inches such that the effective contact area of the v-grooved pulleys (i.e., about 36 inches) may be approximately equal to the effective contact area of the capstan. One example of v-grooved pulleys that may be used to replace capstan 56 is illustrated in FIG. 9 described below.

As the hydrocarbon fluid is forced out of the absorbing material, hydrocarbon fluid 50 may be collected by collection tray 52, which may be configured as described above. In addition, since FIG. 6 illustrates collection tray 52 from a different angle than in FIG. 1, FIG. 6 also illustrates recessed portion 60 surrounded on at least two sides by raised portions 62, which may be configured as described above. In addition, as shown in FIG. 6, the width of the collection tray is greater than the width of the capstan at an upstream end of the collection tray. The width of the collection tray also decreases from the upstream end of the collection tray to the downstream end of the collection tray. In other embodiments, however, the width of the collection tray may be substantially constant across the length of the collection tray. As further described above, hydrocarbon fluid may flow from the downstream end of the collection tray into vessel 54. The collection assembly may be further configured as described herein.

Figure 7:
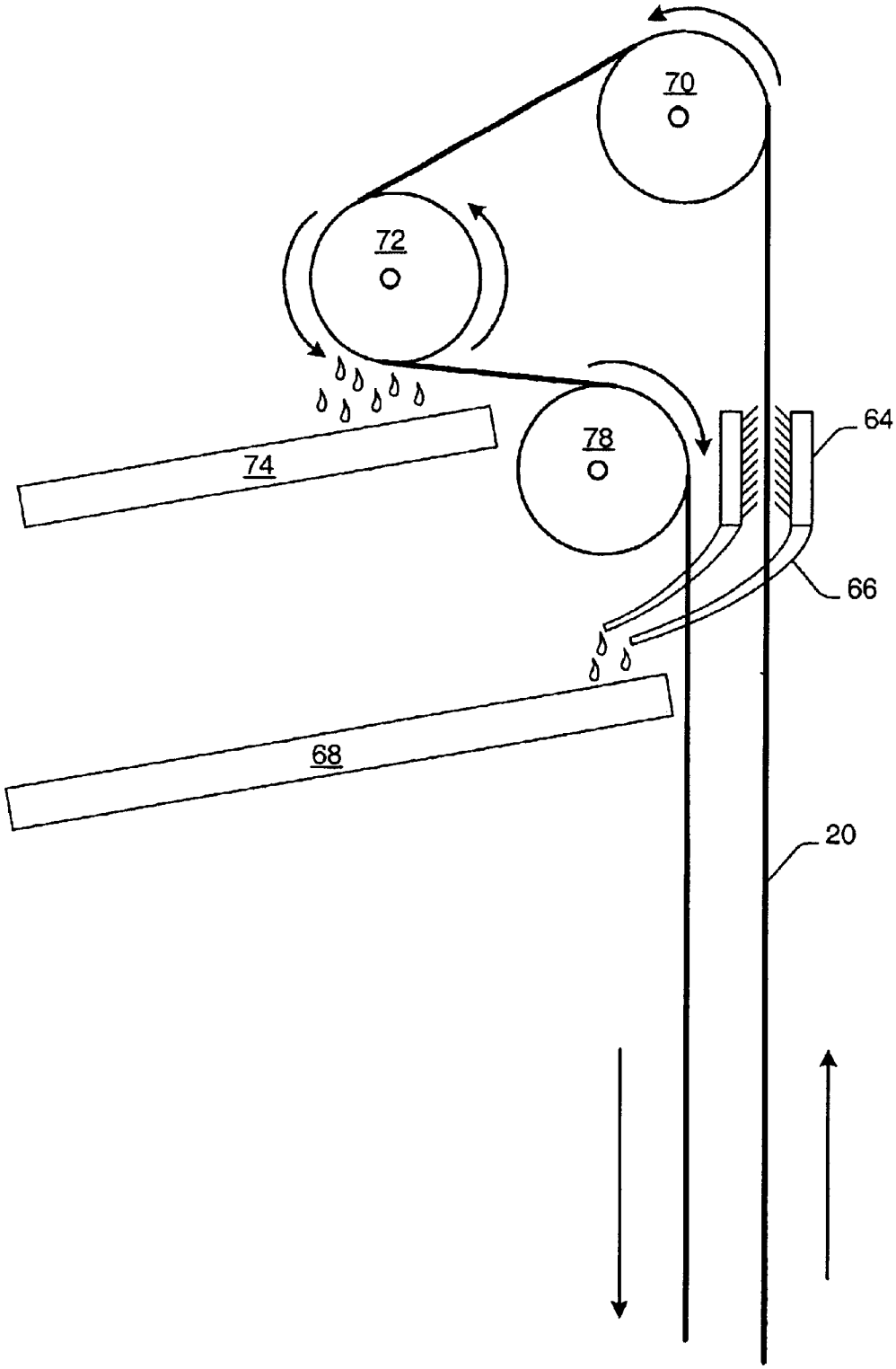

FIG. 7 illustrates another embodiment of a collection assembly. In this embodiment, absorbing material 20 moving out of a well (not shown) or a conduit (not shown) in the well is first contacted by brushes 64. Brushes 64 are configured to remove hydrocarbon fluid from an external surface of the absorbing material. The brushes may remove hydrocarbon fluid from the external surface with or without applying pressure to the absorbing material. In some embodiments, the brushes may be configured to contact the absorbing material over a portion of the circumference of the absorbing material. Alternatively, the brushes may be configured to contact the absorbing material across almost the entire circumference of the absorbing material. Brushes 64 may include or may be coupled to guide members 66. Guide members 66 may be formed of a material such as stainless steel or PVC. In addition, the guide members may be formed of a flexible material, a semi-rigid material, or a rigid material. Guide members 66 may extend from brushes 64 to a position above collection tray 68. Guide members 66 may be configured to collect hydrocarbon fluid removed from the absorbing material by the brushes. Guide members 66 may also be configured such that the collected hydrocarbon fluid flows out of the downstream end of the guide members into collection tray 68. Collection tray 68 may be configured as described above. The collection tray may be configured such that the hydrocarbon fluid can flow through the tray and into a vessel (not shown). The vessel may be configured as described herein.

The collection assembly may also include lead pulley 70. After the absorbing material passes brushes 64, the absorbing material may be wound around lead pulley 70. Lead pulley 70 may be configured to guide the absorbing material from the well or a conduit in the well. In this manner, lead pulley 70 may be considered as part of the drive assembly and as part of the collection assembly. As the absorbing material moves from the brushes to the lead pulley, hydrocarbon fluid may drain from the absorbing material due to gravitational forces and, in some cases, due to tension on the absorbing material. The brushes are configured to collect the hydrocarbon fluid that drains from the absorbing material. In this manner, this hydrocarbon fluid may also flow through guide members 66 and into collection tray 68.

The collection assembly may also include drive spool 72. Drive spool 72 may be configured such that the absorbing material may wrap around the drive spool a number of times. For example, the absorbing material may wrap around the drive spool about 2 times to about 10 times, or about 7 times, sufficient to insure that rolling friction drives the motion of the absorbing material. The drive spool may also be configured to apply pressure to the absorbing material such that the hydrocarbon fluid is removed from the absorbing material. In some embodiments, the drive spool may include one or more v-grooved pulleys or a capstan, which may be configured as described above. Hydrocarbon fluid that is removed from the absorbing material by drive spool 72 may flow freely from the absorbing material and the drive spool into collection tray 74. Hydrocarbon fluid may flow through collection tray 68 and collection tray 74 into the same vessel or into different vessels (not shown). Collection tray 74 and the vessel(s) may be configured as described herein. Alternatively, the apparatus may not include collection tray 74. In such an embodiment, the hydrocarbon fluid removed from the absorbing material by drive spool 72 may flow into collection tray 68. The collection assembly may further include return pulley 78. Return pulley 78 may be configured to guide the absorbing material back into the well or a conduit in the well. In this manner, return pulley 78 may be configured as part of the drive assembly as well as part of the collection assembly. The collection assembly may be further configured as described herein.

Figure 8:
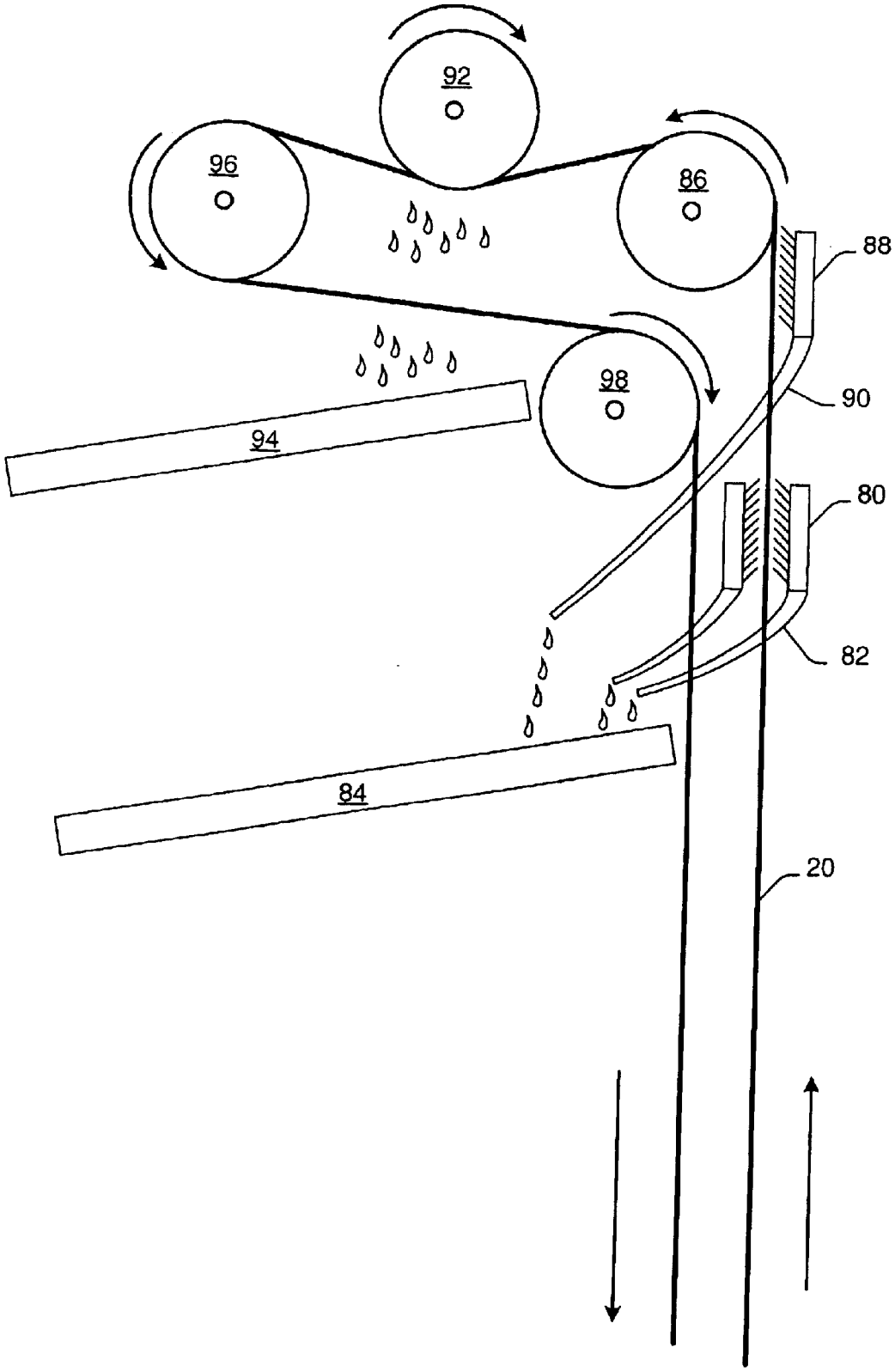

FIG. 8 illustrates an additional embodiment of a collection assembly. The collection assembly includes brushes 80. As absorbing material 20 moves out of a well (not shown) or a conduit (not shown) in the well, the absorbing material is contacted by brushes 80. The brushes may be configured to remove hydrocarbon fluid from an external surface of the absorbing material as described above. The brushes may be further configured as described above. The brushes may include or may be coupled to guide members 82. The guide members may be configured to allow the hydrocarbon fluid removed by brushes 80 to flow into collection tray 84 as described above. The collection tray may be configured to allow the hydrocarbon fluid to flow from a downstream end of the tray into a vessel (not shown) as described above. The guide members, the collection tray, and the vessel may be further configured as described herein.

The collection assembly may also include lead pulley 86. After the absorbing material passes brushes 80, the absorbing material may be wound around lead pulley 86. Lead pulley 86 may be configured to guide the absorbing material from the well or a conduit in the well. In this manner, lead pulley 86 may be considered as part of the drive assembly and as part of the collection assembly. As the absorbing material moves from the brushes to the lead pulley, hydrocarbon fluid may drain from the absorbing material due to gravitational forces and, in some cases, due to tension on the absorbing material. Brushes 80 are configured to collect the hydrocarbon fluid that drains from the absorbing material. In this manner, this hydrocarbon fluid may also flow through guide members 82 and into collection tray 84.

In addition, the collection assembly may include one or more additional brushes 88. Additional brushes 88 may be configured to contact the absorbing material as the absorbing material is wound around lead pulley 86 or before the absorbing material is wound around the lead pulley. Brushes 88 may be configured to remove hydrocarbon fluid from an external surface of the absorbing material as described above. Brushes 88 may be further configured as described above. Brushes 88 may also include or may be coupled to guide members 90. Guide members 90 may be configured to collect hydrocarbon fluid that is removed from the absorbing material by brushes 88. In addition, guide members 90 may be configured to collect hydrocarbon fluid that drains from the absorbing material as the absorbing material moves from the brushes to lead pulley 86. Guide members 90 may also be configured to allow the hydrocarbon fluid to flow from the brushes to collection tray 84. Alternatively, guide members 90 may be configured to allow the hydrocarbon fluid to flow from the brushes to another collection tray (not shown), which may be configured as described above.

The collection assembly may also include drive spool 92. Drive spool 92 may be configured such that the absorbing material may wrap around the drive spool a number of times. For example, the absorbing material may wrap around the drive spool about 2 times to about 5 times, or about 3 times. The drive spool may also be configured to apply pressure to the absorbing material such that the hydrocarbon fluid is removed from the absorbing material. In some embodiments, the drive spool may include one or more v-grooved pulleys or a capstan, which may be configured as described above. Hydrocarbon fluid that is removed from the absorbing material by drive spool 92 may flow freely from the absorbing material and the drive spool into collection tray 94. Collection tray 94 may be configured as described herein. In some embodiments, collection tray 84 and collection tray 94 may allow the hydrocarbon fluid to flow from downstream end of the tray into the same vessel or into different vessels (not shown). Alternatively, the apparatus may not include collection tray 94. In such an embodiment, hydrocarbon fluid that is removed from the absorbing material by drive spool 92 may flow freely into collection tray 84. In addition, the collection assembly may include spring loaded pulley 96. Spring loaded pulley 96 may be configured to maintain tension on the absorbing material such that adequate compression can be achieved to remove the hydrocarbon fluid from the absorbing material. The spring loaded pulley may also be configured to maintain tension on the absorbing material to prevent the absorbing material from slipping. The collection assembly may further include return pulley 98. Return pulley 98 may be configured to guide the absorbing material back into the well or a conduit in the well. In this manner, return pulley 98 may be configured as part of the drive assembly as well as part of the collection assembly. The collection assembly may be further configured as described herein.

FIG. 9 illustrates another embodiment of a collection assembly. The collection assembly includes lead pulley 100. As the absorbing material moves out of a well (not shown) or a conduit (not shown) in the well, the absorbing material is passed over lead pulley 100. Lead pulley 100 may be configured to guide the absorbing material from the well or the conduit in the well. In this manner, lead pulley 100 may be considered as part of the drive assembly and as part of the collection assembly. In some embodiments, lead pulley 100 may have a diameter of about 3.5 inches. In addition, lead pulley may be a v-grooved pulley. The collection assembly also includes drive pulley 102. The absorbing material may be transferred from lead pulley 100 to drive pulley 102. Drive pulley 102 may also be a v-grooved pulley. In some embodiments, drive pulley 102 may have a diameter of about 9 inches. The absorbing material is guided through as much as 75% of the circumference of drive pulley 102 which may be a v-pulley, as illustrated in FIG. 9. After the absorbing material is passed over drive pulley 102, the absorbing material traverses pulley 104. Guide pulley 104 may have a diameter of about 3 inches. Guide pulley 104 may or may not be a v-grooved pulley.

The collection assembly also includes return pulley 106. Return pulley 106 may be a v-grooved pulley having a diameter of about 6 inches. Return pulley 106 is coupled to tension spring 108. The tension spring may also be coupled to a housing (not shown) of the collection assembly. In this manner, the tension spring may couple return pulley 106 to the housing. In some embodiments, the tension spring may be arranged at an angle of about 45° to the return direction of the absorbing material. The tension spring may be configured to maintain adequate tension on the absorbing material such that hydrocarbon fluid can be removed from the absorbing material. In addition, the tension spring may be configured to maintain adequate tension on the absorbing material to prevent the absorbing material from slipping. Such adequate tension may be about 15 lbs to about 200 lbs of pressure. Appropriate values of the adequate tension may vary, however, depending upon characteristics of the apparatus such as the weight of the absorbing material and characteristics of the well such as the depth of the well. In many cases, a significant portion of the tension may be provided by the weight of the rope itself.

After the absorbing material traverses return pulley 106, the absorbing material traverses guide pulley 110. Guide pulley 110 may, in some embodiments, be equivalent to guide pulley 104. For example, guide pulley 110 may or may not be a v-grooved pulley having a diameter of about 3 inches. The collection assembly also include drive pulley 112. Drive pulley 112 may be equivalent to drive pulley 102. For example, drive pulley may be a v-grooved pulley having a diameter of about 9 inches. The absorbing material may traverse as much as 75% or more of the drive pulley 112 as illustrated in FIG. 9. Drive pulleys 102 and 112 provide the primary rolling friction for the series of pulleys. The drive pulleys may be located on a single shaft coupled to an electric motor, a wind driven motor, a fuel-driven motor or a motor driven by any other power source, as described above. The collection assembly further includes guides pulleys 114 and 116. Guide pulleys 114 and 116 may or may not be v-grooved pulleys. Guide pulley 114 may have a diameter of about 3 inches, and guide pulley 116 may have a diameter of about 3.5 inches. Guide pulley 116 may be configured to guide the absorbing material back into the well or a conduit in the well. Therefore, guide pulley 116 may be part of the collection assembly as well as part of the drive assembly.

The collection assembly illustrated in FIG. 9, therefore, includes a system of pulleys. The collection assembly, much like the collection assemblies illustrated in the above figures, is advantageous because it is relatively simple to design and to operate. In addition, each of the pulleys described herein may be obtained commercially and are usually off-the-shelve items. Therefore, the collection assemblies that include such pulley systems are relatively inexpensive. Furthermore, the collection assemblies described herein are relatively light in weight. As such, the collection assemblies may be relatively easy to install or maintain. Furthermore, each of the pulleys in each of the above described collection assemblies may be v-grooved pulleys. Although the collection assemblies may include a number of non-v-grooved pulleys, v-grooved pulleys may provide increased compression on the absorbing material for removing hydrocarbon fluid from the absorbing material compared to channel-grooved pulleys or capstans. Therefore, increasing the number of v-grooved pulleys in the collection assembly will generally increase the rate at which hydrocarbon fluid is removed from the absorbing material and/or the amount of hydrocarbon fluid that is removed from the absorbing material.

The collection assembly illustrated in FIG. 9 may include a number of other components described herein. For example, the collection assembly may include a collection tray (not shown). The collection tray may be configured to collect hydrocarbon fluid from each of the pulleys that remove hydrocarbon fluid from the absorbing material. The collection tray may also be configured such that the hydrocarbon fluid flows from a downstream end of the collection tray to a vessel (not shown). The collection tray and the vessel may be further configured as described above. The collection assembly illustrated in FIG. 9 may also include one or more brushes (not shown), which may be configured as described above to remove hydrocarbon fluid from external surfaces of the absorbing material. The brushes may be further configured as described above. Furthermore, in some embodiments, the drive pulleys of the collection assembly may be replaced with a winch-like mechanism. The collection assembly may be further configured as described herein.

In addition, it is to be understood that the collection assemblies described above may be modified in a number of ways without modifying the principle of operation. For example, the positions and the diameters of the pulleys may be modified without reducing the efficiency of the collection assembly. In particular, the diameters of the pulleys may be changed as long as the pulleys that are also a part of the drive assembly have sufficient rolling friction to move the absorbing material out of the well or out of a conduit in the well, which may vary depending on the rolling surface area of the pulley system. In this manner, the pulley system may be altered very easily to account for different characteristics of the apparatus.

As described above, the absorbing material may be compressed such that the hydrocarbon fluid can be removed from the absorbing material using a pulley, a capstan, or a sequence of pulleys. In addition, the absorbing material may be compressed using any other rotating surface that may be configured to provide sufficient rolling friction to move the absorbing material through the entire apparatus. Other mechanisms for moving the absorbing material, however, may also be used. For example, one mechanism that may be used to apply pressure to the absorbing material is reciprocating mechanical actions. Another device that may be used to apply pressure to the absorbing material may include two rotating drums through which the absorbing material may be passed such that the absorbing material is squeezed between the drums or opposing pulleys or other pressure applying mechanisms. In addition, any other mechanism or device that may be configured to apply adequate compression to the absorbing material to remove the hydrocarbon fluid from the absorbing material may be included in the collection assembly. In addition, the hydrocarbon fluid may be removed from the absorbing material through application of compressed gases. In the context of the methods and apparatus described herein, "adequate compression" is achieved if the contact surface area between the absorbing material and the turning mechanism is sufficient to provide adequate rolling friction to keep the absorbing material from slipping. In this manner, the compression mechanism also serves as at least a portion of the driving mechanism to cycle the absorbing material through the well.

Another embodiment relates to a method for producing a hydrocarbon fluid from a formation. The method includes moving an absorbing material through a well disposed in the formation. Moving the absorbing material through the well may be performed as described above. For example, in one embodiment, moving the absorbing material through the well includes moving the absorbing material through a production zone in the well. Hydrocarbon fluid and water may be disposed in the production zone. In addition, in some embodiments, the absorbing material may include a continuous loop of the absorbing material. In such embodiments, moving the absorbing material through the well may include continuously cycling the absorbing material through the well.

The absorbing material may be configured as described herein. Therefore, as the absorbing material is moved through the well, the absorbing material absorbs the hydrocarbon fluid in the well without absorbing a substantial amount of water in the well. For example, the absorbing material may include a porous hydrophobic material surrounding a hollow core. In such embodiments, hydrocarbon fluid may be absorbed through pores in the absorbing material and into the hollow core. In additional embodiments, moving the absorbing material through the well may include moving the absorbing material out of the well through a conduit as described above. In such embodiments, hydrocarbon fluid may be trapped between an external surface of the absorbing material and an internal surface of the conduit as the absorbing material moves into the conduit.

The method also includes removing hydrocarbon fluid from the absorbing material. Removing hydrocarbon fluid from the absorbing material may be performed as described above. If the absorbing material includes a continuous loop of the absorbing material, moving the absorbing material through the well and removing the hydrocarbon fluid from the absorbing material may be performed continuously. In some embodiments, the hydrocarbon fluid may be removed from the absorbing material as the absorbing material is moved out of the well. In additional embodiments, removing the hydrocarbon fluid from the absorbing material may include applying pressure to the absorbing material as described above. In further embodiments, if the hydrocarbon fluid is trapped between an external surface of the absorbing material and an internal surface of a conduit, the method may include collecting the trapped hydrocarbon fluid as the absorbing material moves out of the conduit. The trapped hydrocarbon fluid may be collected as described above. The method may be further configured as described herein.

An additional embodiment relates to an apparatus for selectively producing a liquid phase fluid from a formation. The apparatus includes an absorbing material configured to absorb the liquid phase fluid without absorbing a substantial amount of other liquid phase fluids. In some embodiments, the absorbing material may be hydrophobic as described above. In other embodiments, the absorbing material may be hydrophilic. In this manner, the apparatus described above may essentially be reversed. For example, the absorbing material described above may be hydrophilic instead of hydrophobic. As such, although the hydrophilic material may not necessarily separate aqueous fluids from non-aqueous fluids, the apparatus may be used to extract aqueous fluids such as water from a well without extracting a substantial amount of other fluids such as non-aqueous fluids. The non-aqueous fluids may or may not include hydrocarbon fluids.

In one example, the hydrophilic material may include one of the hydrophobic materials described above that has been modified to alter the wettability of the hydrophobic material. For example, if polypropylene is immersed in water for a period of time, the surface tension of the polypropylene may be altered such that the polypropylene may be adequately hydrophilic. In another example, polypropylene may be treated with a chemical such as isopropyl alcohol (IPA) to alter the wettability characteristics of the otherwise hydrophobic material such that the material is adequately hydrophilic. In another embodiment, the hydrophilic material may include any natural or synthetic hydrophilic polymer. Such hydrophilic polymers may be configured as described above. Therefore, the apparatus may be advantageously used to extract water from a source or a well that may or may not contain a substantial amount of contaminants. Although the extracted water may include some of the contaminants such as hydrocarbon fluids, the extracted water may include substantially less contaminants than water produced by other conventional techniques. As such, the apparatus may provide a much more economically viable system for extracting water from a water source that may or may not contain a substantial fraction of contaminants.

The apparatus also includes a drive assembly configured to move the absorbing material through a well disposed in the formation. The drive assembly may be configured as described above. The liquid phase fluid and the other liquid phase fluids are disposed in the well. In addition, the apparatus includes a collection assembly configured to remove the liquid phase fluid from the absorbing material. The collection assembly and the apparatus may be further configured as described herein.

A further embodiment relates to a method for selectively producing a liquid phase fluid from a formation. The method includes moving an absorbing material through a well disposed in the formation. Moving the absorbing material through the well may be performed as described above. For example, in one embodiment, moving the absorbing material through the well includes moving the absorbing material through a production zone in the well. The liquid phase fluid and in some cases other liquid phase fluids may be disposed in the production zone. As the absorbing material is moved through the well, the absorbing material absorbs the liquid phase fluid in the well without absorbing a substantial amount of the other liquid phase fluids in the well. The absorbing material may be configured as described herein. For example, in some embodiments, the absorbing material may be hydrophobic as described above.

In other embodiments, the absorbing material may be hydrophilic as described above. In this manner, the method described above may essentially be reversed. As such, although the method may not necessarily include separating aqueous fluids from non-aqueous fluids, the method may include extracting aqueous fluids such as water from a well without extracting a substantial amount of other fluids such as non-aqueous fluids. The non-aqueous fluids may include hydrocarbon fluids. The method also includes removing the fluid from the absorbing material. Removing the fluid from the absorbing material may be performed as described above. The method may be further configured as described herein.

The method may, therefore, advantageously include extracting water from a source or a well that may or may not contain a substantial amount of contaminants. Although the extracted water may include some of the contaminants such as hydrocarbon fluids, the extracted water may include substantially less contaminants than water produced by other conventional techniques. As such, the method may provide a much more economically viable method for extracting water from a water source that may or may not contain a substantial fraction of contaminants.

It will be appreciated to those skilled in the art having the benefit of this disclosure that this invention is believed to provide methods and apparatus for subterranean fluid separation and removal. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method for producing a liquid phase hydrocarbon fluid from a formation, comprising:

moving an absorbing material through a well disposed in the formation, wherein the absorbing material absorbs the liquid phase hydrocarbon fluid in the well during said moving without absorbing a substantial amount of water from the well, and wherein the absorbing material comprises porus hydrophobic material surrounding a hollow core; and removing the fluid from the absorbing material.

2. The method of claim 1, wherein said moving comprises moving the absorbing material through a production zone in the well, and wherein the fluid and the water are disposed in the production.

3. The method of claim 1, wherein the absorbing material comprises a continuous loop of the absorbing material, and wherein said moving and said removing are performed continuously.

4. The method of claim 1, wherein said removing is performed as the absorbing material is moved out of the well.

5. The method of claim 1, wherein said removing comprises applying pressure to the absorbing material.

6. The method of claim 1, wherein said moving comprises moving the absorbing material out of the well through a conduit, wherein the fluid is trapped between an external surface of the absorbing material and an internal surface of the conduit as the absorbing material moves into the conduit, and the method further comprising collecting the trapped fluid as the absorbing material moves out of the conduit.

7. An apparatus for producing a liquid phase hydrocarbon fluid from a formation, comprising:

an absorbing material configured to absorb the liquid phase hydrocarbon fluid without absorbing a substantial amount of water, wherein the absorbing material comprises a porus material surrounding a hollow core, and wherein the porus material is configured to allow the fluid to pass through the porus material into the hollow core;

a drive assembly configured to move the absorbing material through a well disposed in the formation, wherein the fluid and the water are disposed in the well; and a collection assembly configured to remove the fluid from the absorbing material.

8. The apparatus of claim 7, wherein the fluid and the water are further disposed within a production zone in the well, and wherein the drive assembly is further configured to move the absorbing material through the production zone.

9. The apparatus of claim 7, wherein the absorbing material is hydrophobic.

10. The apparatus of claim 7, wherein the absorbing material comprises a hydrophobic polymer.

11. The apparatus of claim 7, wherein the absorbing material comprises a continuous loop of the absorbing material.

12. The apparatus of claim 7, wherein the absorbing material comprises a continuous loop of the absorbing material, and wherein the drive assembly is further configured to continuously move the absorbing material through the well.

13. The apparatus of claim 7, wherein substantially solid plugs are disposed within the hollow core and spaced from each other within the hollow core.

14. The apparatus of claim 7, wherein annular plugs are coupled to an external surface of the absorbing material and spaced from each other across the external surface.

15. The apparatus of claim 7, further comprising two conduits disposed within the well, wherein the two conduits have substantially smooth internal surfaces, and wherein the drive assembly is further configured to move the absorbing material into the well through a first of the two conduits and out of the well through a second of the two conduits.

16. The apparatus of claim 15, wherein the absorbing material and the second of the two conduits are further configured to trap the fluid between an external surface of the absorbing material and the internal surface of the second of the two conduits.

17. The apparatus of claim 16, wherein the collection assembly is further configured to collect the fluid trapped between the external surface of the absorbing material and the internal surface of the second of the two conduits.

18. The apparatus of claim 7, further comprising a conduit disposed within the well, wherein the drive assembly is further configured to move the absorbing material out of the well through the conduit, and wherein an internal diameter of the conduit is approximately equal to an external diameter of the absorbing material after expansion of the absorbing material caused by absorption of the fluid.

19. An apparatus for selectively producing a liquid phase fluid from a formation, comprising:

an absorbing material configured to absorb the liquid phase fluid without absorbing a substantial amount of other liquid phase fluids, wherein the absorbing material comprises a porus material surrounding a hollow core, and, wherein the porous material is configured to allow the fluid to pass through the porous material into the hollow core;

a drive assembly configured to move the absorbing material through a well disposed in the formation, wherein the liquid phase fluid and the other liquid phase fluids are disposed in the well; and a collection assembly configured to remove the liquid phase fluid from the absorbing material.

20. The apparatus of claim 19, wherein the absorbing material is hydrophobic or hydrophilic.

* * * * *

UNITED STATES PATENT AND TRADEMARK OFFICE

CERTIFICATE OF CORRECTION

PATENT NO. : 6,868,911 B1
DATED : March 22, 2005
INVENTOR(S) : Jacobson et al.

It is certified that error appears in the above-identified patent and that said Letters Patent is hereby corrected as shown below:

Title page,
Item [74], *Attorney, Agent, or Firm*, please delete "Ann Marie Mewherjer" and substitute therefor -- Ann Marie Mewherter --.

Signed and Sealed this

Eighth Day of November, 2005

JON W. DUDAS
*Director of the United States Patent and Trademark Office*